United States Patent [19]

Schroeder et al.

[11] Patent Number: 4,685,205

[45] Date of Patent: Aug. 11, 1987

[54] APPARATUS FOR FORMING AN EXPLOSIVELY EXPANDED TUBE-TUBE SHEET JOINT INCLUDING A BARRIER TUBE

[75] Inventors: Joseph W. Schroeder, Clark; Kawaljit S. Ahluwalia, Montville, both of N.J.

[73] Assignee: Foster Wheeler Development Corporation, Livingston, N.J.

[21] Appl. No.: 768,997

[22] Filed: Aug. 26, 1985

[51] Int. Cl.[4] ..... B23P 15/26; B23P 17/00; B21D 53/00

[52] U.S. Cl. ..... 29/727; 29/33 T; 29/157.3 C; 29/157.4; 29/283.5; 29/421 E; 29/522 R; 72/56; 72/706; 228/2.5

[58] Field of Search ..... 29/33 T, 157.3 C, 157.4, 29/283.5, 421 E, 505, 522 R, 723, 727; 72/54, 56, 60, 61, 62, 706; 228/2.5

[56] References Cited

U.S. PATENT DOCUMENTS

| | | | |
|---|---|---|---|
| 3,206,845 | 9/1965 | Crump | 29/282 |
| 3,411,198 | 11/1968 | Berman et al. | 29/421 E |
| 3,555,656 | 1/1971 | Brown et al. | 29/421 E X |
| 3,562,887 | 2/1971 | Schroeder et al. | 29/421 E X |
| 3,566,646 | 3/1971 | Walkup | 72/56 |
| 3,590,877 | 7/1971 | Leopold et al. | 228/2.5 X |
| 3,661,004 | 5/1972 | Lee et al. | 72/56 |
| 3,785,291 | 1/1974 | Bergbauer et al. | 29/157.4 X |
| 3,790,060 | 2/1974 | Feiss | 228/2.5 |
| 3,919,940 | 11/1975 | Ploger et al. | 29/157.4 X |
| 3,993,001 | 11/1976 | Hawes | 228/2.5 X |
| 4,028,789 | 6/1977 | Loch | 228/2.5 X |
| 4,030,419 | 6/1977 | Loch | 29/421 E X |
| 4,106,687 | 8/1978 | Bement | 228/2.5 |
| 4,117,966 | 10/1978 | Green et al. | 228/2.5 |
| 4,205,422 | 6/1980 | Hardwick | 29/421 E X |

*Primary Examiner*—Howard N. Goldberg
*Assistant Examiner*—Ronald S. Wallace
*Attorney, Agent, or Firm*—Marvin A. Naigur; Warren B. Kice

[57] ABSTRACT

Apparatus for expanding a tube into a bore formed in a tube sheet in which a tubular force-transmitting member extends within the tube coextensive with the portion of the tube to be expanded. An explosive is disposed in the bore of the force-transmitting member, so that the forces resulting from the explosion of the explosive are uniformly transferred by the force-transmitting member to expand the tube into the bore. A tubular barrier member extends between the force-transmitting member and the tube and has a portion projecting from the tube sheet, and a plug is disposed in the end of the projecting portion of the barrier member to contain the debris and gases resulting from the explosion.

7 Claims, 1 Drawing Figure

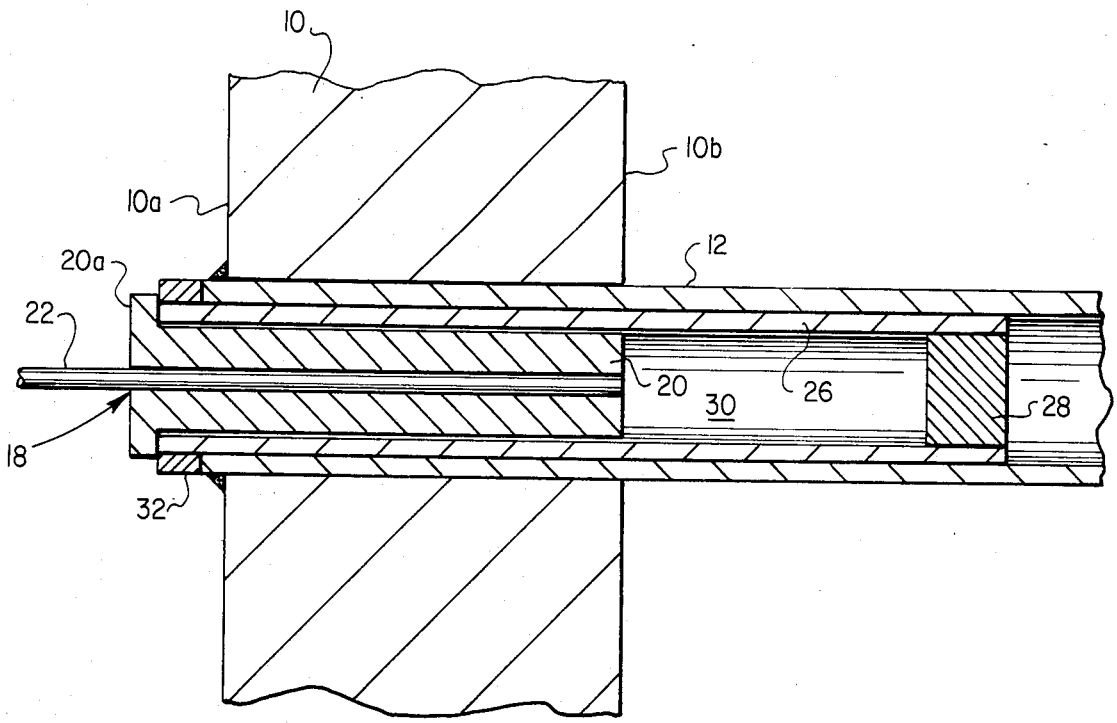
10
10b
10a
12
20a
22
20
30
26
28
18
32

APPARATUS FOR FORMING AN EXPLOSIVELY EXPANDED TUBE-TUBE SHEET JOINT INCLUDING A BARRIER TUBE

BACKGROUND OF THE INVENTION

This invention relates to an apparatus for explosively forming a tube into a bore formed in a tube sheet, and more particularly, to such an apparatus utilizing an explosive which is placed within the tube to be expanded.

Many current designs of heat exchangers feature the use of a plurality of heat exchange tubes disposed within bores extending through a tube sheet. The tubes receive a primary fluid which is passed through the tubes in a heat exchange relationship with a secondary fluid passing over the tubes.

Various techniques have evolved for securing the tubes within the tube sheet. For example, the tubes have been mechanically expanded into the tube sheets utilizing a mandrel or the like, or by rolling, i.e., by applying an outward radial force against the entire surface of the tubes. However, these techniques enjoy several disadvantages including local metal deformation, general lengthening of the tubes, and the application of axial stresses on the tube weld and compressive strains in the tube wall.

In order to overcome the foregoing disadvantages, a technique of explosively forming the tubes within the tube sheet has evolved. According to this technique, an explosive charge is disposed within the area of overlap between the tubes and the tube sheet and is surrounded by a force-transmitting member which, upon detonation of the explosive charge, expands the tube uniformly against the inner wall of the tube sheet.

Recently there has been much interest in using explosive expansion of the above type to repair tube-tube sheet joints in nuclear steam generators. However, as a result of the explosion, the polyethylene force-transmitting member fractures, leaving debris which must be removed from the tubes prior to their reuse. In addition, the gases generated by the explosive are not contained and are allowed to travel down the tube carrying along vaporized polyethylene. This contamination, because of the levels of radiation, is extremely costly to remove.

SUMMARY OF THE INVENTION

It is therefore an object of the present invention to provide an apparatus for securing a tube within a tube sheet in which the tube is explosively formed within the tube sheet without the problems set forth above.

It is a further object of the present invention to provide an apparatus of the above type in which a barrier tube is provided between the explosive and the tube which contains the debris and gases resulting from the explosion.

Toward the fulfillment of these and other objects, the apparatus of the present invention utilizes a tubular force-transmitting member that extends within said tube coextensive with the portion of the tube to be expanded. The forces resulting from the explosion of an explosive placed within the force-transmitting member are uniformly transferred to the tube to expand the tube. A barrier tube extends between the said force-transmitting member and the tube and has a portion projecting from the tube sheet. A plug is disposed in the end of the projecting portion of the barrier tube to contain the debris and gases resulting from the explosion.

DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawing which is a longitudinal cross-sectional view of a tube-tube sheet interface and depicting the apparatus of the present invention.

DESCRIPTION OF THE PREFERRED EMBODIMENT

Referring to the drawing, the reference numeral 10 refers in general to a tube sheet which can form a portion of a heat exchanger having a plurality of heat exchange tubes, one of which is shown by the reference numeral 12. Each tube 12 extends within a corresponding bore formed with the tube sheet 10, with one end of each of the tubes extending immediately adjacent the outer surface 10*a* of the tube sheet. The other end of the tube 12 projects from the inner surface 10*b* of the tube sheet and extends into the interior of the heat exchanger.

The outer diameter of the tube 12 is slightly less than the inner diameter of the tube sheet bore and the tube is secured to the outer surface 10*a* of the tube sheet 10 by an annular weldment 14. Only a portion of the tube 12 is shown in the interest of clarity, it being understood that the heat exchanger would also include a vessel enclosing the tube sheet and having suitable inlets and outlets for a primary heat exchange fluid and a secondary heat exchange fluid. According to a typical arrangement of this type, each tube 12 would be U-shaped, with both ends of the tube extending through the tube sheet 10. The primary heat exchange fluid enters each tube 12 through the end shown adjacent the outer surface 10*a* of the tube sheet 10, passes through the tube in a heat exchange relation with a secondary fluid passing through the vessel to the right of the tube sheet, and exits through the other end of the tube.

The tube 12 is depicted in the drawing prior to it being explosively formed in the tube sheet 10, along with the apparatus of the present invention for effecting the explosive forming. The latter apparatus includes an insert, shown in general by the reference numeral 18, which extends within that portion of the tube 12 extending coextensively with the tube sheet 10. The insert 18 consists of a generally tubular force-transmitting member 20 and a rodshaped explosive member 22 extending within the bore of the force-transmitting member 20. The force-transmitting member 20 has an outside diameter which is less than the inner diameter of the tube 12, and one end of the force-transmitting member 20 extends flush with the inner surface 10*b* of the tube sheet 10, while the other end projects slightly from the outer surface 10*a* of the tube sheet. A shoulder 20*a* is provided on the projecting end of the force-transmitting member 20 for reasons that will be described later.

The explosive member 22 contains a determined number of grains of explosive distributed uniformly along its axis. One end of the explosive member 22 extends flush with the corresponding end of the force-transmitting member 20 and with the inner surface 10*b* of the tube sheet 10. The other end of the explosive member 22 projects from the corresponding end of the force-transmitting member 20 and is connected to an energy transfer cord or the like (not shown) which connects a detonator cap (not shown) with the explosive member 22 for igniting it, in a conventional manner.

A barrier tube 26 is provided within the tube 12 and has a first portion extending between the force-transmitting member 20 and the inner wall of the tube 12, and another portion projecting from the inner surface of 10*b* of the tube sheet 10 for a distance corresponding approximately to the width of the tube sheet. One end of the barrier tube 26 engages the shoulder 20*a* of the force-transmitting member 20, and an end plug 28 is disposed within the other end of the barrier tube. A chamber 30 is thus defined by the barrier tube 26 and the corresponding surfaces of the forcetransmitting member 20 and the end plug 28.

A collar 32 extends between the shoulder 20*a* and the tube 12 to precisely locate the force-transmitting member 20, and therefore the barrier tube 26, relative to the tube 12.

The force-transmitting member 20 can be fabricated from a low cost plastic material having good energy transmission characteristics, such as polyethylene; while the barrier tube 26 can be of a high strength and impact resistant material such as fluroplastic, nylon, polyurethane elastomer, or the like. The thickness of the wall of the barrier tube 26 is less than that of the force-transmitting member 20 so that its lower energy transmission characteristics are minimized, but is great enough to withstand the impact of the explosive forces.

The force-transmitting member 20 and the barrier tube 26 can be fabricated separately by any known plastic processing method or, alternatively, can be coextruded with the barrier tube 26 being extruded over the force-transmitting member in one operation.

In operation, the explosive member 22 is detonated in the manner discussed above and the resulting forces are transmitted, via the force-transmitting member 20 and through the tube 26, uniformly to the tube 12 to cause a uniform expansion of the tube against the wall portion of the bore in the tube sheet 10. The high strength characteristics of the barrier tube 26 prevent it from fracturing, and the gases and debris resulting from the explosion are thus contained in the chamber 20, preventing any contamination in the interior of the heat exchanger.

It is understood that several variations may be made in the foregoing without departing from the scope of the invention. For example, the exact materials used, including the number and type of explosive, of the various components can be varied within the scope of the invention..

Other modifications, changes and substitutions are intended in the foregoing disclosure and, in some instances, some features of the invention can be employed without a corresponding use of other features. Accordingly, it is appropriate that the appended claims be construed broadly and in a manner consistent with the spirit and scope of the invention therein.

What is claimed is:

1. Apparatus for expanding a tube into a bore formed in a tube sheet and extending from the outer surface to the inner surface thereof, said apparatus comprising a tubular force-transmitting member extending within said tube coextensive with the portion of the tube to be expanded, explosive means disposed in the bore of said force-transmitting member, said force-transmitting member and said explosive means extending flush with said inner surface of said tube sheet, a tubular barrier member extending between said force-transmitting member and said tube, means for locating said force-transmitting member and said barrier member relative to said outer surface of said tube sheet, a portion of said barrier member projecting from said inner surface of said tube sheet coextensive with a corresponding portion of said tube, and a plug disposed in the end of said projecting portion of said barrier member, said plug, said force-transmitting member and said barrier member defining a chamber, said force-transmitting member and said barrier member being constructed and arranged so that they transmit the forces resulting from the explosion of said explosive means to said tube to expand said tube into said bore, and said barrier member being constructed and arranged to withstand the impact of said forces so that the debris and gases resulting from said explosion are contained in said chamber.

2. The apparatus of claim 1 wherein said explosive means is in the form of a rod-shaped member containing grains of explosive disposed uniformly along its axis.

3. The apparatus of claim 1 wherein said barrier member is formed of a stronger material than that of said force-transmitting member.

4. The apparatus of claim 3 wherein said force-transmitting member is fabricated of a material that has greater energy transmission characteristics than that of said barrier member.

5. The apparatus of claim 3 wherein the wall thickness of said barrier member is less than that of said force-transmitting member to minimize the effects of the lower energy transmission characteristics of said barrier member.

6. The apparatus of claim 1 wherein said locating means comprises a shoulder formed on said force-transmitting member and a collar extending between said shoulder and said tube.

7. The apparatus of claim 6 wherein an end of said barrier tube abuts said shoulder.

* * * * *